US007418214B2

(12) United States Patent
Yoshida et al.

(10) Patent No.: US 7,418,214 B2
(45) Date of Patent: Aug. 26, 2008

(54) STATE DETECTION MECHANISM

(75) Inventors: Wataru Yoshida, Hirakata (JP); Keiji Kato, Nara (JP); Fumito Mizoguchi, Beijing (CN); Atsushi Inoue, Nara (JP)

(73) Assignee: Sharp Kabushiki Kaisha, Osaka-Shi, Osaka (JP)

( * ) Notice: Subject to any disclaimer, the term of this patent is extended or adjusted under 35 U.S.C. 154(b) by 0 days.

(21) Appl. No.: 11/633,552

(22) Filed: Dec. 5, 2006

(65) Prior Publication Data

US 2007/0140709 A1 Jun. 21, 2007

(30) Foreign Application Priority Data

Dec. 16, 2005 (JP) ..... 2005-363885

(51) Int. Cl.
*G03G 15/00* (2006.01)

(52) U.S. Cl. ..... 399/12; 399/13

(58) Field of Classification Search ..... 399/12, 399/13, 24, 25, 111, 358
See application file for complete search history.

(56) References Cited

U.S. PATENT DOCUMENTS 6,792,217 B2 9/2004 Nishino et al.
2005/0123322 A1* 6/2005 Okamoto et al. ..... 399/258
2006/0263102 A1* 11/2006 Ishii ..... 399/12

FOREIGN PATENT DOCUMENTS

| | | | |
|---|---|---|---|
| JP | 2-99980 | A | 4/1990 |
| JP | 2-308277 | A | 12/1990 |
| JP | 9-258634 | A | 10/1997 |
| JP | 2003-271039 | A | 9/2003 |

* cited by examiner

*Primary Examiner*—David M. Gray
*Assistant Examiner*—Kristofferson Service
(74) *Attorney, Agent, or Firm*—Birch, Stewart, Kolasch & Birch, LLP

(57) ABSTRACT

A state detection mechanism includes a movable member, a spring member, a fringesection, and a stopper member. The spring member displaces the movable member arranged at the first predetermined position to a second predetermined position by applying restoration force in a D direction to the movable member. The fringe section restricts the displacement by abutting to a protrusion member formed on the movable member arranged at the first predetermined position. The stopper member restricts rotation of the movable member, which rotates around an axis that extends in a D direction, by abutting to the protrusion member formed on the movable member arranged at the first predetermined position. When torque is transmitted to the movable member from a shaft, the movable member rotates wound an axis that extends in the D direction, and the protrusion member and the stopper member abut to each other.

5 Claims, 5 Drawing Sheets

STATE DETECTION MECHANISM

This Nonprovisional application claims priority under 35 U.S.C. § 119(a) on Patent Application No. 363885/2005 filed in Japan on Dec. 16, 2005, the entire contents of which are hereby incorporated by reference.

FIELD OF THE INVENTION

The present invention relates to a state detection mechanism which allows a main apparatus to detect that a replaceable member attached detachably to the main apparatus is in a new state, in case where the replaceable member is in the new state.

BACKGROUND OF THE INVENTION

An image formation apparatus such as a copying machine is provided with various kinds of process cartridges, for example, a photosensitive cartridge, a developer tank cartridge, a charging unit, and a cleaner unit, which are attached detachably to the image formation apparatus. Some of these cartridges deteriorate through usage. Consumable materials in some others among these cartridges are used up. Therefore, each of the cartridges needs to be replaced with another cartridge at an appropriate time. At this replacement, on one hand, the cartridge is replaced with a cartridge in a new state. However, on the other, the cartridge is replaced with a used cartridge (hereinafter, referred to as a cartridge in a used state), which has been used before but still usable.

In many of the image formation apparatuses, usage history of a process cartridge is recorded in order to (i) detect an appropriate time for replacing the process cartridge and then notify an operator of the appropriate time for the replacement and (ii) optimize process conditions according to the usage history of the process cartridge.

In case where the cartridge newly attached has not been used before (hereinafter, referred to as in an unused state) (in the new state), there is no problem in recording the usage history from a time when the cartridge is attached. However, in case where the cartridge newly attached is in the used state, the cartridge has been already used to a certain degree. Consequently, if the usage history of the cartridge in the used state is recorded from the time when the cartridge is attached in the same manner as the cartridge in the new state, the usage history may cause an error in (i) detecting the time for replacing the process cartridge or/and (ii) optimizing process conditions. Therefore, it is preferable that the image formation apparatus is arranged so as to be able to identify whether the process cartridge is in the unused state or in the used state when the process cartridge is attached to the image formation apparatus.

For example, Patent Documents 1 through 3 listed below disclose means for allowing the image formation apparatus to identify whether the cartridge attached is in the unused state or in the used state when the process cartridge is attached to the image formation apparatus.

(Patent Document 1)

Japanese Unexamined Patent Publication No. 99980/1990 (Tokukaihei 2-99980 (published on Apr. 11, 1990))

(Patent Document 2)

Japanese Unexamined Patent Publication No. 308277/1990 (Tokukaihei 2-308277 (published on Dec. 21, 1990))

(Patent Document 3)

Japanese Unexamined Patent Publication No. 271039/2003 (published on Sep. 25, 2003)

Patent Document 3 discloses an initial detection mechanism 200 as illustrated in FIGS. 6(*a*) and 6(*b*). This initial detection mechanism 200 is provided to a photosensitive cartridge attached to an image formation apparatus. The initial detection mechanism 200 includes (i) a shaft 230, (ii) a mobile body 210 fit on the shaft 230 so as to be capable of sliding in a direction of an arrow F (hereinafter, referred to as an F direction), and (iii) a cover member 220 on which an opening 220*a* is formed. The mobile body 210 has an axis body 210*a*.

According to this initial detection mechanism 200, when the photosensitive cartridge is in the unused state, as illustrated in FIG. 6(*a*), the mobile body 210 is arranged at a position where the axis body 210*a* passes through the opening 220*a* from an inside of the cover member 220 and comes in contact with a sensor 250 of the image formation apparatus. Hereinafter, the position where the mobile body 210 is arranged as illustrated in FIG. 6(*a*) is referred to as a position a.

The mobile body 210 at the position a is pressed in a direction parting from the sensor 250 (the F direction) by a spring member 260 being compressed. However, the displacement of the mobile body 210 due to the pressure from the spring member 260 is restricted by a protrusion 210*b* formed on an outer periphery surface of the axis body 210*a*. The protrusion 210*b* restricts the displacement by abutting on an outer surface of the cover member 220 around the opening 220*a*. Thus, the mobile body 210 stays at the position a.

When the photosensitive cartridge is used, the shaft 230 rotates. Along with rotation of the shaft 230, the mobile body 210 and the axis body 210*a* also rotate (rotate around an axis that extends in the F direction). Moreover, due to this rotation, the protrusion 210*b* formed on the axis body 210*a* slides on the outer surface of the cover member 220 around the opening 220*a* of the cover member 220. Eventually, the protrusion 210*b* moves up to a position where the protrusion 210*b* faces a cut (not illustrated) made by cutting off a part of the outer surface of the cover member 220.

When the protrusion 210*b* faces the cut, the protrusion 210*b* does not abut to the outer surface of the cover member 220. This moves the mobile body 210 to the direction parting from the sensor 250 (in the F direction) by restoration force of the spring member 260. Moreover, as illustrated in FIG. 6(*b*), the mobile body 210 stops moving when a bottom surface inside the mobile body 210 abuts to an end of the shaft 230. As a result, the axis body 210*a* is arranged at a position away from the sensor 250. Hereinafter, the position where the mobile body 210 is arranged as illustrated in FIG. 6(*b*) is referred to as a position b.

The mobile body 210 arranged at the position b is supported by being pressed by the spring member 260 towards the end of the shaft 230. Accordingly, although the mobile body 210 supported at the position b may move a little in the direction of the position a (an opposite direction to the F direction) due to vibrations or the like, the mobile body 210 is eventually pushed back to the position b by the spring member 260. Consequently, the mobile body 210 is kept at the position b, and never goes back to the position a automatically.

According to the initial detection mechanism 200 as explained above, when the photosensitive cartridge is in the unused state, the mobile body 210 is arranged at the position a, and the axis body 210*a* of the mobile body 210 is in contact with the sensor 250 of the image formation apparatus. In case where the sensor 250 is in contact with the axis body 210*a*, the image formation apparatus identifies that the photosensitive cartridge is in the unused state.

Moreover, when the photosensitive cartridge is used, the mobile body 210 moves from the position a to the position b and the axis body 210*a* is away from the sensor 250. In case where the sensor 250 is not in contact with the axis body 210*a*, the image formation apparatus identifies that the photosensitive cartridge is in the used state.

In this way, in the initial detection mechanism 200, the image formation apparatus can identify whether the photosensitive cartridge is in the unused state or not.

In the initial detection mechanism 200, the mobile body 210 moves from the position a to the position b when the photosensitive cartridge comes to be in the used state from the unused state. Then, the mobile body 210 never returns to the position a automatically. However, it is possible by hand of an operator (a) to disassemble the initial detection mechanism 200 and (b) to reassemble the initial detection mechanism 200 so that the mobile body 210 is arranged at the position a again. The reason why this procedure is made possible is that the mobile body 210 is rearranged at the position a in the initial detection mechanism 200 of this photosensitive cartridge after the photosensitive cartridge returns to the new state (the unused state) by recycling of the photosensitive cartridge that has been used up and collected.

However, there may be a case where the photosensitive cartridge in the used state is to be reattached to the image formation apparatus, which photosensitive cartridge has been removed from the image formation apparatus and left in the used state (usable). In the arrangement mentioned above, an user or the like, who does not know that the photosensitive cartridge is in the used state, may (a) disassemble the initial detection mechanism 200 and (b) reassemble the initial detection mechanism 200 so that the mobile body 210 is arranged at the position a again. If such a case occurs, the image formation apparatus mistakenly identifies that the photosensitive cartridge, which is in the used state and reattached to the image formation apparatus, is in the unused state.

SUMMARY OF THE INVENTION

An object of the present invention is to provide a state detection mechanism which allows for detection of a state of a replaceable member attached to a main apparatus. The state detection mechanism of the present invention can suppress the occurrence of wrong detection, compared with a conventional state detection mechanism.

The state detection mechanism of the present invention, in order to achieve the object mentioned above, includes: a supporting mechanism provided in a replaceable member attached detachably to a main apparatus; and a movable member supported by the supporting mechanism, wherein: (i) the movable member is arranged at a first predetermined position when the replaceable member is in an unused state in which the replaceable member has never been used by the main apparatus and (ii) the movable member is arranged at a second predetermined position when the unused state is cancelled, the second predetermined position being away from the first predetermined position; and the main apparatus detects the unused state by detecting the movable member arranged at the first predetermined position. The state detection mechanism further includes: torque transmission member for transmitting torque to the movable member by driving force from the main apparatus when the replaceable member is used in the main apparatus; and a protrusion member formed on the movable member, wherein: the supporting mechanism includes: a movable-member displacement member for (a) supporting the movable member and (b) displacing the movable member arranged at the first predetermined position to the second predetermined position by applying a pressure towards the second predetermined position to the movable member; a first restriction member for restricting the displacement by abutting to the protrusion member formed on the movable member arranged at the first predetermined position; and a second restriction member for restricting rotation of the movable member in a direction identical to a direction of rotation caused by the torque by abutting to the protrusion member formed on the movable member arranged at the first predetermined position; and the protrusion member is destroyed by load caused by the torque exerted on a section where the second restriction member and the protrusion member abut to each other, when the torque is transmitted to the movable member.

According to the arrangement mentioned above, when the replaceable member is in the unused state, the movable member is arranged at the first predetermined position. After the unused state is cancelled, the movable member is arranged at the second predetermined position that is away from the first predetermined position. The main apparatus identifies the unused state by detecting the movable member arranged at the first predetermined position.

When the replaceable member is used in the main apparatus, the torque transmission member transmits the torque to the movable member arranged at the first predetermined position. Moreover, this transmission of the torque to the movable member arranged at the first predetermined position produces the load caused by the torque on the section where the protrusion member of the movable member and the second restriction member abut to each other. This load destroys the protrusion member. Due to this destruction, the movable member arranged at the first predetermined position loses the protrusion member which abuts to the first restriction member. This cancels the restriction to the displacement of the movable member from the first predetermined position to the second predetermined position. Consequently, the movable member arranged at the first predetermined position is displaced to the second predetermined position due to the restoration force (pressure towards the second predetermined position) exerted by the movable-member displacement member. Therefore, when the replaceable member is used (that is, when the unused state is cancelled), it becomes possible to displace the movable member, which has been arranged at the first predetermined position in the unused state, to the second predetermined position.

In the arrangement mentioned above, after the unused state is cancelled, the protrusion member formed on the movable member is destroyed. Therefore, even if someone other than a qualified supplier, for example, a user, tries to move the movable member back by force manually to the first predetermined position, the restriction does not work to the displacement of the movable member from the first predetermined position to the second predetermined position. As a result, the movable member is arranged at the second predetermined position due to the pressure applied by the movable-member displacement member.

Accordingly, the arrangement mentioned above does not allow the user or the like to reassemble by hand the state detection mechanism so as to return the movable member from the second predetermined position to the first predetermined position. Therefore, after the unused state is cancelled, it does not happen that the movable member is returned to the first predetermined position by hand of, for example, the user.

As a result, it becomes possible to suppress the occurrence of an event such that the replaceable member in the used state is mistakenly detected as being in the unused state.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a schematic diagram of a cross section of the conventional initial detection mechanism in a state where the axis body is away from the sensor.

DESCRIPTION OF THE EMBODIMENTS

An embodiment of the present invention is explained below with reference to figures.

Figure 5:
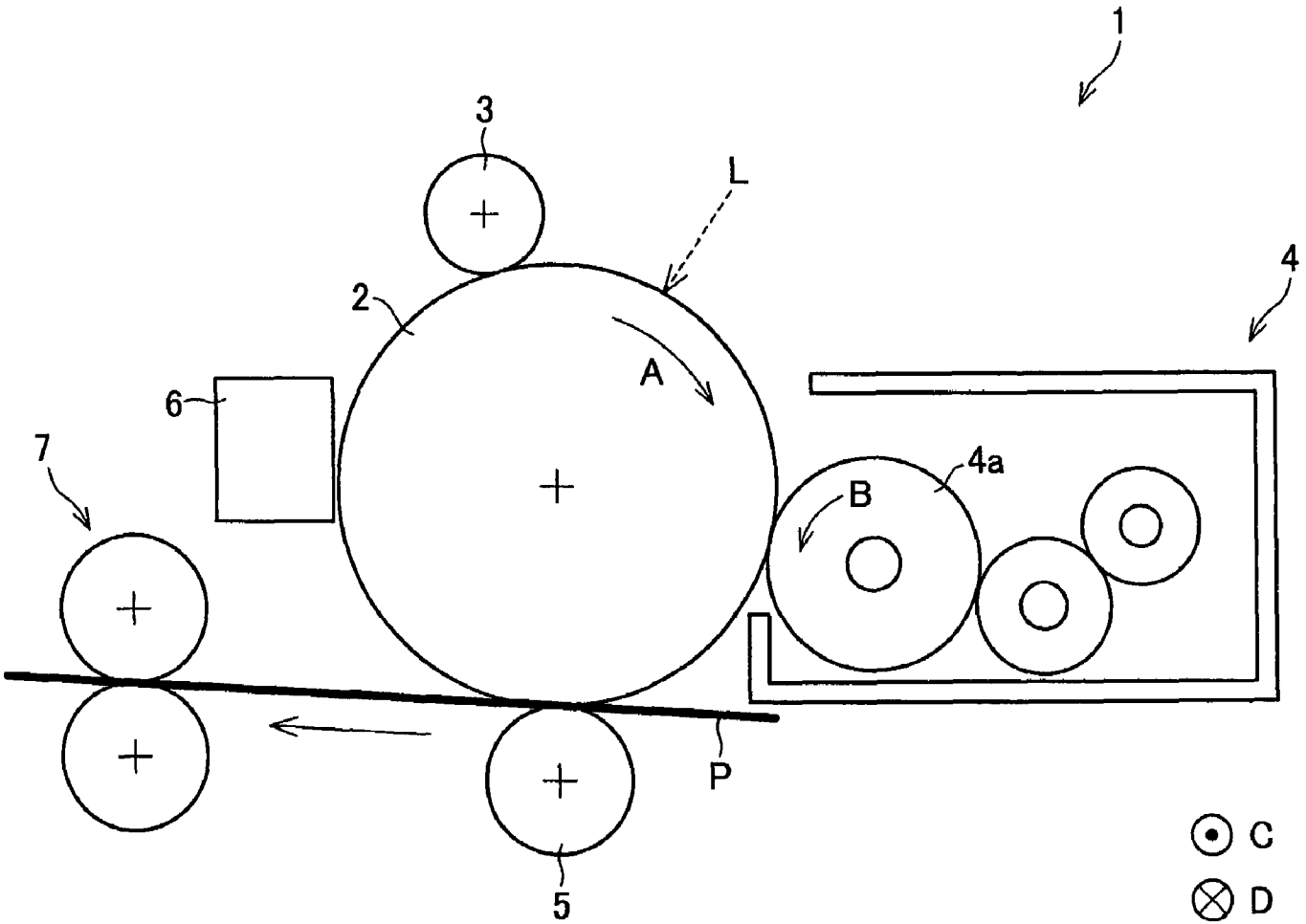
FIG. 5 is a schematic diagram illustrating an arrangement inside an image formation apparatus into which the photosensitive cartridge including the state detection mechanism of the embodiment of the present invention is installed.
Figure 6:
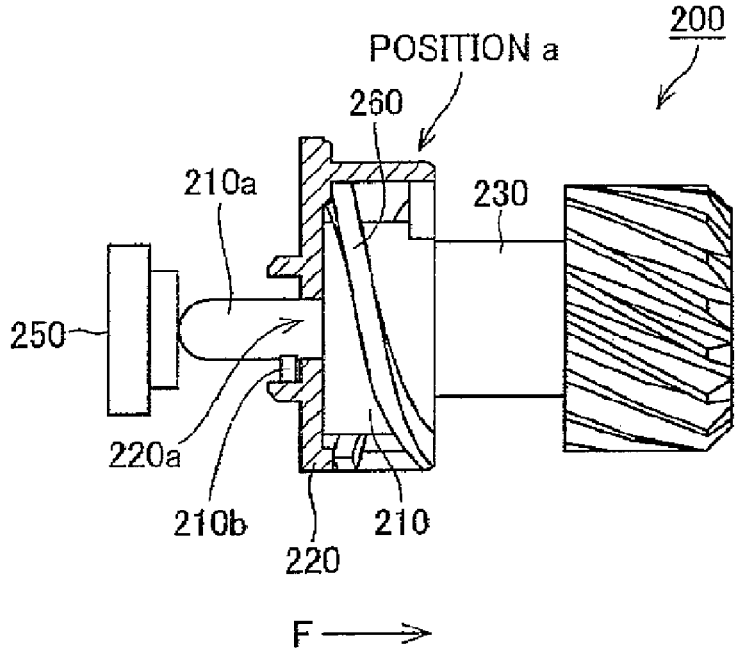
FIG. 6 (a) CONVENTIONAL ART
FIG. 6(*a*) is a schematic diagram of a cross section of a conventional initial detection mechanism in a state where an axis body is in contact with a sensor.
Figure 6:
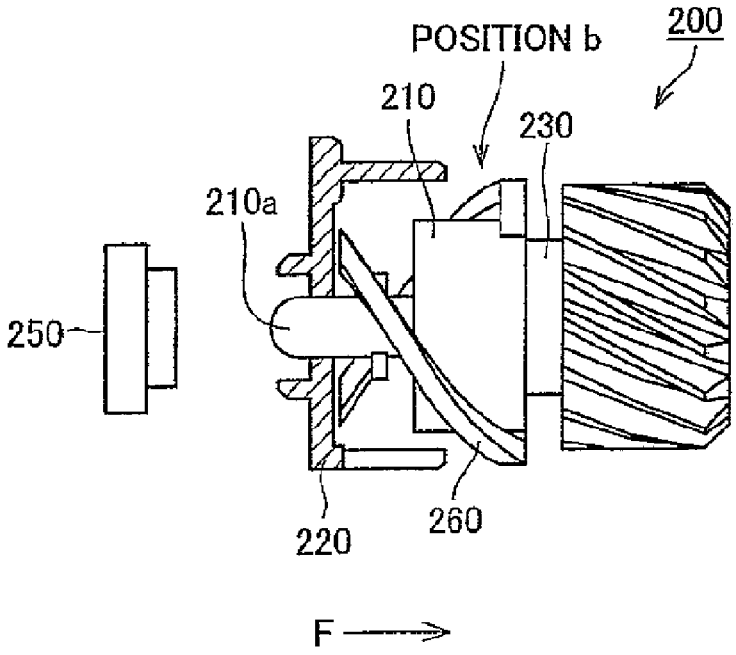
FIG. 6 (b) CONVENTIONAL ART

First, the following is a brief explanation of an image formation apparatus (a main apparatus) into which a photosensitive cartridge (a replaceable member) including a state detection mechanism of the present embodiment is installed. FIG. 5 is a schematic diagram illustrating an arrangement inside the image formation apparatus 1.

The image formation apparatus 1 is an electrophotographic laser printer. As illustrated in FIG. 5, the image formation apparatus 1 includes a photosensitive drum 2, a charging roller 3, an exposure section (not illustrated), a developing device 4, a transfer-use discharging roller 5, a cleaning section 6, a diselectrification section (not illustrated), and a fixing device 7. In FIG. 5, P and L respectively refer to recording paper and an optical beam which enters from the exposure section so as to write a static latent image on a surface of the photosensitive drum 2.

The photosensitive drum 2 rotates in a predetermined direction (a direction indicated by an arrow A in FIG. 5; an A direction). Firstly, the charging roller 3 evenly charges an outer periphery surface of the photosensitive drum 2. Then, on the surface of the photosensitive drum 2 uniformly charged, the static latent image is formed by irradiation of the optical beam L controlled by the exposure section according to image data. The static latent image formed is kept on the surface of the photosensitive drum 2.

The photosensitive drum 2 is included in the photosensitive cartridge mentioned above. This photosensitive cartridge is attached to the image formation apparatus 1 detachably. The arrangement of the photosensitive cartridge is explained in detail later.

The static latent image formed on the photosensitive drum 2 is transported to a position facing the developing device 4 by rotation of the photosensitive drum 2. The static latent image is visualized as a toner image by toner supplied from the developing device 4. At this visualization, a developing roller 4*a* of the developing device 4 rotates in a predetermined direction (a direction indicated by an arrow B; a B direction) so as to hold and transport the toner to be supplied to the photosensitive drum 2.

In the present embodiment, the photosensitive drum 2 is made of organic optical semiconductor. The photosensitive drum 2 is charged to −700V by the charging roller 3. The developing roller 4*a* is made of a conductive elastomeric material that is cylindrical. A developing bias of −400V is applied to the developing roller 4*a* and the developing roller 4*a* rotates in the B direction at a peripheral velocity equal to that of the photosensitive drum 2.

The transfer-use discharging roller 5 transfers the toner image formed on the photosensitive drum 2 onto a sheet of paper P. The cleaning section 6 is provided at a downstream of the transfer-use discharging roller 5 with respect to the direction in which the photosensitive drum 2 rotates. The cleaning section 6 removes residual toner on the surface of the photosensitive drum 2. Moreover, the diselectrification section, which is not illustrated, is provided at a further downstream of the cleaning section 6. The diselectrification section removes electricity from the surface of the photosensitive drum 2.

The fixing device 7 is constituted by a pair of rollers. When the paper P on which the toner image has been transferred is carried between the rollers, the fixing device 7 applies heat and pressure on the paper P in order to fix the toner image onto the paper P.

Next, the photosensitive cartridge included in the photosensitive drum 2 is explained with reference to FIG. 1.

Figure 1:
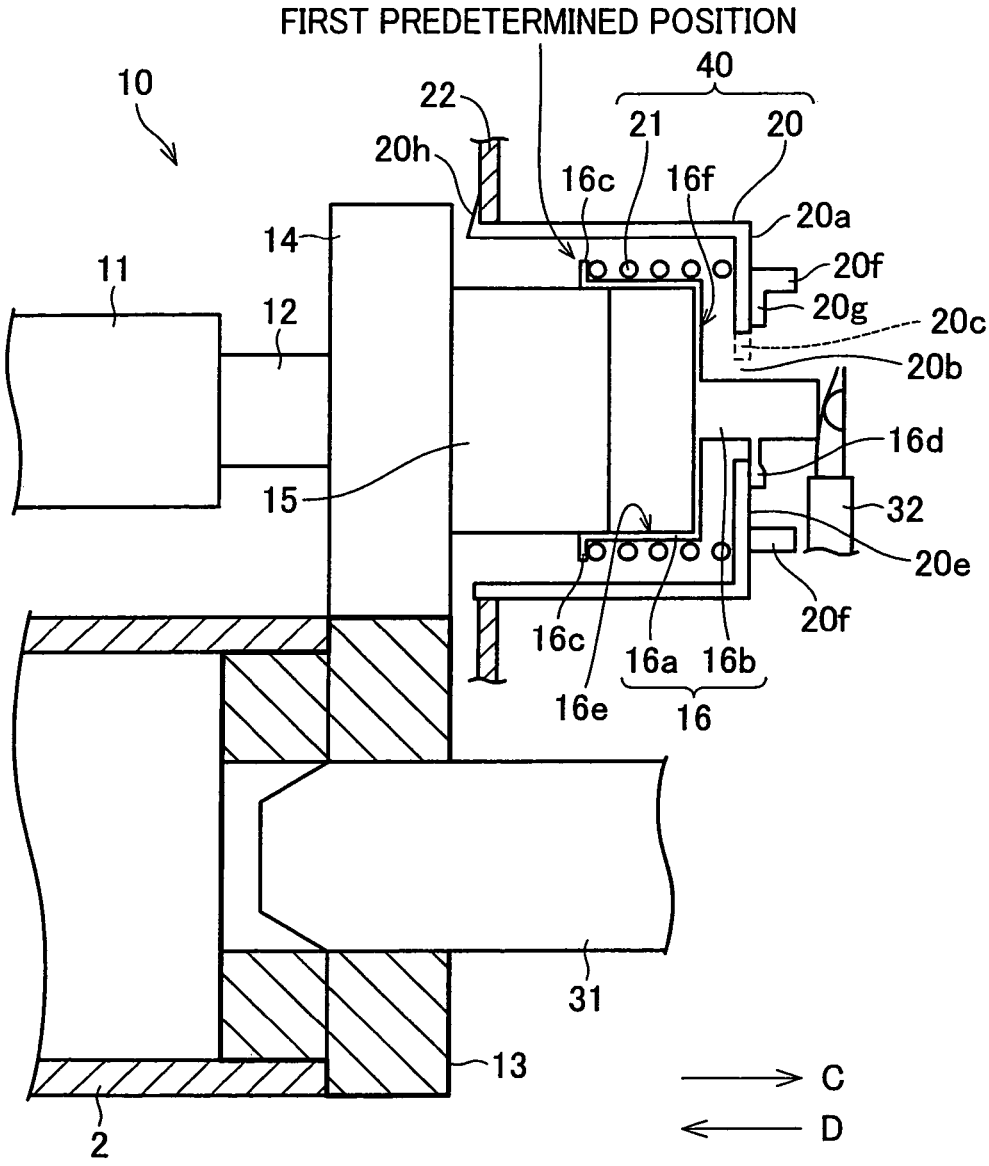
FIG. 1 is a schematic diagram illustrating a cross section of a part of a photosensitive cartridge including a state detection mechanism of an embodiment of the present invention, and illustrating a state where a movable member is arranged at a first predetermined position.

FIG. 1 is a schematic diagram illustrating a cross section of a part of a photosensitive cartridge 10 including the state detection mechanism of the present embodiment.

The photosensitive cartridge 10, as illustrated in FIG. 1, includes the photosensitive drum 2, a first driving shaft 31, a waste toner transport screw 11, a second driving shaft 12, a gear 13, a gear 14, a shaft 15, a movable member 16, a cover 20, a spring member 21, and a frame 22. The first driving shaft 31 is cylindrical and serves as a rotation driving shaft of the photosensitive drum 2. The second driving shaft 12 is cylindrical and serves as a rotation driving shaft of the waste toner transport screw 11. The shaft 15 is also cylindrical. Note that the state detection mechanism of the present embodiment includes the shaft 15, the movable member 16, the cover 20, and the spring member 21, in the explanation above. Moreover, the cover 20 and the spring member 21 realize a supporting mechanism 40 for supporting the movable member 16.

The photosensitive cartridge 10 is attached to the image formation apparatus 1 by being inserted toward a C direction, and detached from the image formation apparatus 1 by being pulled out in a D direction. The C direction is a direction from a front side to a backside of the image formation apparatus 1 and the D direction is a direction from the backside to the front side of the image formation apparatus 1.

The photosensitive drum 2 is fit around the first driving shaft 31 at a middle part in a longitudinal direction of the first driving shaft 31. The first driving shaft 31 serves as a center axis around which the photosensitive drum 2 is cylindrically formed. The first driving shaft 31 rotates around a rotation axis that extends in the D direction in FIG. 1, when driving force is transmitted from a motor (not illustrated) provided in the image formation apparatus 1.

The waste toner transport screw 11 is a screw type conveyer which transports the waste toner collected at the cleaning section 6 in FIG. 5. This waste toner transport screw 11 is attached to a part of the second driving shaft 12 so that the waste toner transport screw 11 has an axis in the same direction as an axis of the second driving shaft 12.

The gear 13 is provided around the first driving shaft 31 so as to form a loop. The gear 14 is engaged with the gear 13.

Moreover, the gear 14 has a through hole (not illustrated) formed in a direction of a rotation axis of the gear 14. An end section of the shaft 15 is inserted into an opening on one side of the through hole in the gear 14 so that the rotation axis of the gear 14 and a rotation axis of the shaft 15 agree. In this manner, the shaft 15 is fixed to the gear 14. Furthermore, an end section of the second driving shaft 12 is inserted into an opening on the other side of the through hole in the gear 14 so that the rotation axis of the gear 14 and the rotation axis of the second driving shaft 12 agree. In this manner, the second driving shaft 12 is fixed to the gear 14.

In the arrangement mentioned above, when the photosensitive cartridge 10 starts to be used, torque produced by the driving force from the motor is applied to the first driving shaft 31. Then, the photosensitive drum 2 and the gear 13 rotate in the same direction around the rotation axis that extends in the D direction.

The gear 14 rotates around the rotation axis that extends in the D direction, and the gear 14 rotates in a direction which is opposite to the rotation direction of the gear 13. Moreover, when the gear 14 rotates, the shaft 15 and the waste toner transport screw 11 also rotate in the same direction around the same rotation axis as the gear 14. By this rotation, the waste toner transport screw 11 transports the waste toner collected by the cleaning section in FIG. 4.

In other words, the driving force from the image formation apparatus 1 provides the torque to the first driving shaft 31. Then, this torque is further transmitted to the shaft 15 and the waste toner transport screw 11.

Figure 2:
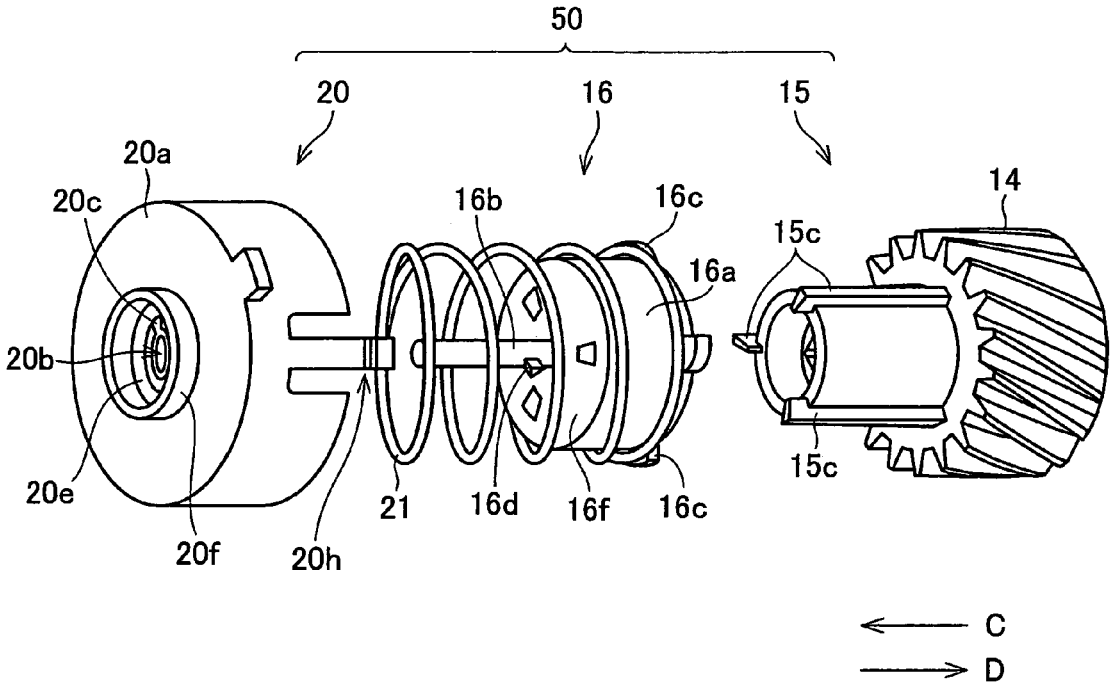
FIG. 2 is an exploded perspective view of the state detection mechanism of the embodiment of the present invention.

Next, with reference to FIGS. 1 and 2, detailed explanation is given on the state detection mechanism including the shaft 15, the movable member 16, and the supporting mechanism 40 (the cover 20, the spring member 21). FIG. 2 is an exploded perspective view illustrating a state detection mechanism 50.

As illustrated in FIG. 2, the shaft 15 is provided with ribs 15*c* on its outer periphery surface. The ribs 15*c* extend along a direction parallel to the D direction (the direction of the rotation axis of the shaft 15) like a rail. In the arrangement, these ribs 15*c* stand so as to have equal heights in a direction perpendicular with respect to the D direction. Moreover, three of the ribs 15*c* are provided so that the ribs 15*c* are spaced apart from each other evenly in a direction along a periphery of the shaft 15.

As illustrated in FIGS. 1 and 2, the movable member 16 includes a cylinder section 16*a* and an axis body 16*b*. The axis body 16*b* has a cylindrical shape whose diameter is smaller than that of the cylinder section 16*a* and protrudes substantially from a center of a bottom surface 16*f* of the cylinder section 16*a*. The cylinder section 16*a* is provided with flanges 16*c* on its outer periphery surface. The axis body 16*b* is provided with a protrusion member 16*d* on its outer periphery surface. The axis body 16*b* protrudes from the cylinder section 16*a* so that center axes of the cylinder section 16*a* and the axis body 16*b* agree.

Moreover, the cylinder section 16*a* is a hollow member which is open on its side facing the bottom surface 16*f*. The cylinder section 16*a* has guiding channels (not illustrated), which fit with the ribs 15*c* and slide over the ribs 15*c*, on an inner periphery surface 16*e* (refer to FIG. 1) of the cylinder section 16*a*. The number of the guiding channels is three, which corresponds to the number of the ribs 15*c*. The guiding channels are provided so as to be spaced apart evenly in a direction along a periphery of the inner periphery surface 16*e*.

The ribs 15*c* are respectively engaged into the guiding channels. Then, as illustrated in FIG. 1, an end section of the shaft 15 (the end section opposite to the other end section inserted into the gear 14) is fit into the cylinder section 16*a*. In a state as illustrated in FIG. 1, the shaft 15 is fit into the cylinder section 16*a* in such a manner that (i) the one end section of the shaft 15 is inserted into the cylinder section 16*a*, (ii) the other end section is inserted into the gear 14, and (iii) a middle section of the shaft 15 between the end sections is exposed outside together with a part of the ribs 15*c*. Moreover, in the state as illustrated in FIG. 1, the shaft 15 is fit into the cylinder section 16*a* so as to form a cavity between a back surface of the bottom surface 16*f* of the cylinder section 16*a* and the shaft 15. This allows the movable member 16 to slide on the shaft 15 in the D direction.

Figure 3:
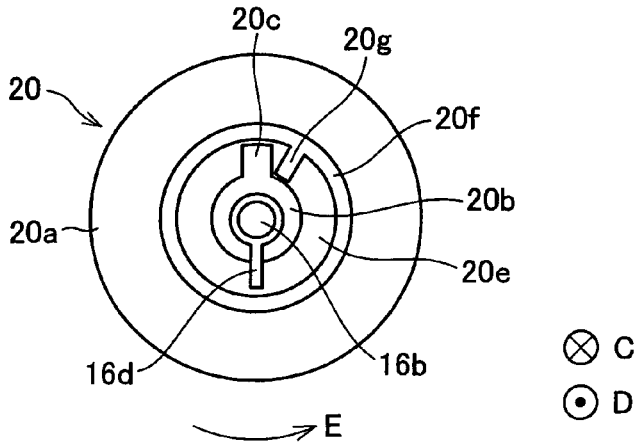
FIG. 3 is a schematic diagram illustrating a cover included in the state detection mechanism of the embodiment of the present invention.

Next, an arrangement of the cover 20 is explained in detail with reference to FIGS. 1 through 3. FIG. 3 is a schematic diagram illustrating the cover 20 viewed from the backside of the image formation apparatus 1.

The cover 20, as illustrated in FIGS. 1 and 2, has a shape of a hollow cylinder which is open on its side facing a bottom surface 20*a* so as to form a cavity inside. The cover 20 is attached to the photosensitive cartridge 10.

As illustrated in FIGS. 1 and 3, the cover 20 has an opening 20*b* in the center of the bottom surface 20*a*. The opening 20*b* is circular and has a diameter larger than that of the axis body 16*b*. The cover 20 also includes a fringe section 20*e* and a cut 20*c*. The fringe section 20*e* is provided around the opening 20*b* on an outer surface of the cover 20. The cut 20*c* is formed by cutting a part of the fringe section 20*e*. The cover 20 further includes a wall section 20*f* shaped like a ring. The wall section 20*f* is provided so as to stand in the C direction from the bottom surface 20*a* and surrounds the fringe section 20*e* and the cut 20*c*. In addition, the cover 20 has a stopper member 20*g* which is formed so as to extend from the wall section 20*f* towards the opening 20*b* and protrude in the C direction from a part of the fringe section 20*e*.

As illustrated in FIG. 1, the movable member 16 is inserted inside the cover 20 so that an end of the axis body 16*b* points in the C direction.

In case where the photosensitive cartridge 10 is in the unused state (new state), the movable member 16 is disposed so that the axis body 16*b* passes through the opening 20*b* from the inside of the cover 20 and comes in contact with a sensor 32 of the image information apparatus 1.

In the present embodiment, the axis body 16*b* of the movable member 16 passes through the opening 20*b* by a procedure described below. First, the end of the axis body 16*b* is arranged so as to face the inside of the cover 20. Then, the protrusion member 16*d* formed on the outer periphery surface of the axis body 16*b* is brought to face the cut 20*c*. Then, the axis body 16*b* is inserted into the opening 20*b*. This procedure prevents the protrusion member 16*d* from being caught by the wall surface inside the cover 20. After the protrusion member 16*d* passes through the cut 20*c* from the inside of the cover 20, the movable member 16 is turned substantially half around in an E direction, as illustrated in FIG. 3. As illustrated in FIGS. 1 and 3, this brings the protrusion member 16*d* of the movable member 16 so as to abut on the fringe section 20*e* of the cover 20.

In case where the photosensitive cartridge 10 is in the unused state (not used in the image formation apparatus 1), the movable member 16 is arranged at the position as illustrated in FIGS. 1 and 3 so that the protrusion member 16*d* abuts on the fringe section 20*e*. Hereinafter, the position of the movable member 16 as illustrated in FIGS. 1 and 3 is referred to as a first predetermined position.

Moreover, the spring member 21 is provided between the movable member 16 and the inside of the cover 20. One end of the spring member 21 is engaged with the flange 16*c* of the movable member 16, and the other end of the spring member 21 abuts on a back surface of the bottom surface 20*a* of the cover 20. Thus, the movable member 16 is elastically supported by the supporting mechanism 40 which is constituted by the cover 20 and the spring member 21.

In a state where the movable member 16 is arranged at the first predetermined position, the spring member 21 is compressed inside the cover 20. As illustrated in FIG. 1, the movable member 16 is pressed in a direction parting from the sensor 32 (the D direction) by spring restoration force exerted by the spring member 21 being compressed. However, because the protrusion member 16*d* on the axis body 16*b* of the movable member 16 abuts on the fringe section 20*e* of the cover 20, the displacement due to the spring restoration force is restricted. Accordingly, the movable member 16 stays at the first predetermined position.

In the arrangement as illustrated in FIGS. 1 through 3, the torque produced by the driving force from the image formation apparatus 1 is applied to the shaft 15 when the photosensitive cartridge 10 is used. This rotates the shaft 15. The rotation of the shaft 15 further rotates the movable member 16. Namely, the shaft 15 (torque transmission member) transmits the torque from the image formation apparatus 1 further to the movable member 16. The movable member 16 rotates by the torque transmitted in this way. A rotation direction of this rotation is the E direction in FIG. 3. An axis direction of this rotation is the D direction in FIG. 1.

This rotation allows the protrusion member 16*d* to slide on the fringe section 20*e* around the opening 20*b* until the protrusion member 16*d* abuts to the stopper member 20*g*. This stopper member 20*g* is provided at a position where the stopper member 20*g* can restrict the rotation of the movable member 16 (rotation in the E direction in FIG. 3) by abutting to the protrusion member 16*b*. When the protrusion member 16*b* abuts to the stopper member 20*g*, the torque mentioned above causes load on the section where the protrusion member 16*d* and the stopper member 20*g* abut to each other. This load destroys the protrusion member 16*d*.

The destruction of the protrusion member 16*d* cancels restriction on the displacement of the movable member 16, which displacement is caused by the restoration force exerted by the spring 21 being compressed. Consequently, the restoration force causes the movable member 16 to slide on the shaft 15 and move in the direction parting from the sensor 32 (the D direction).

Figure 4:
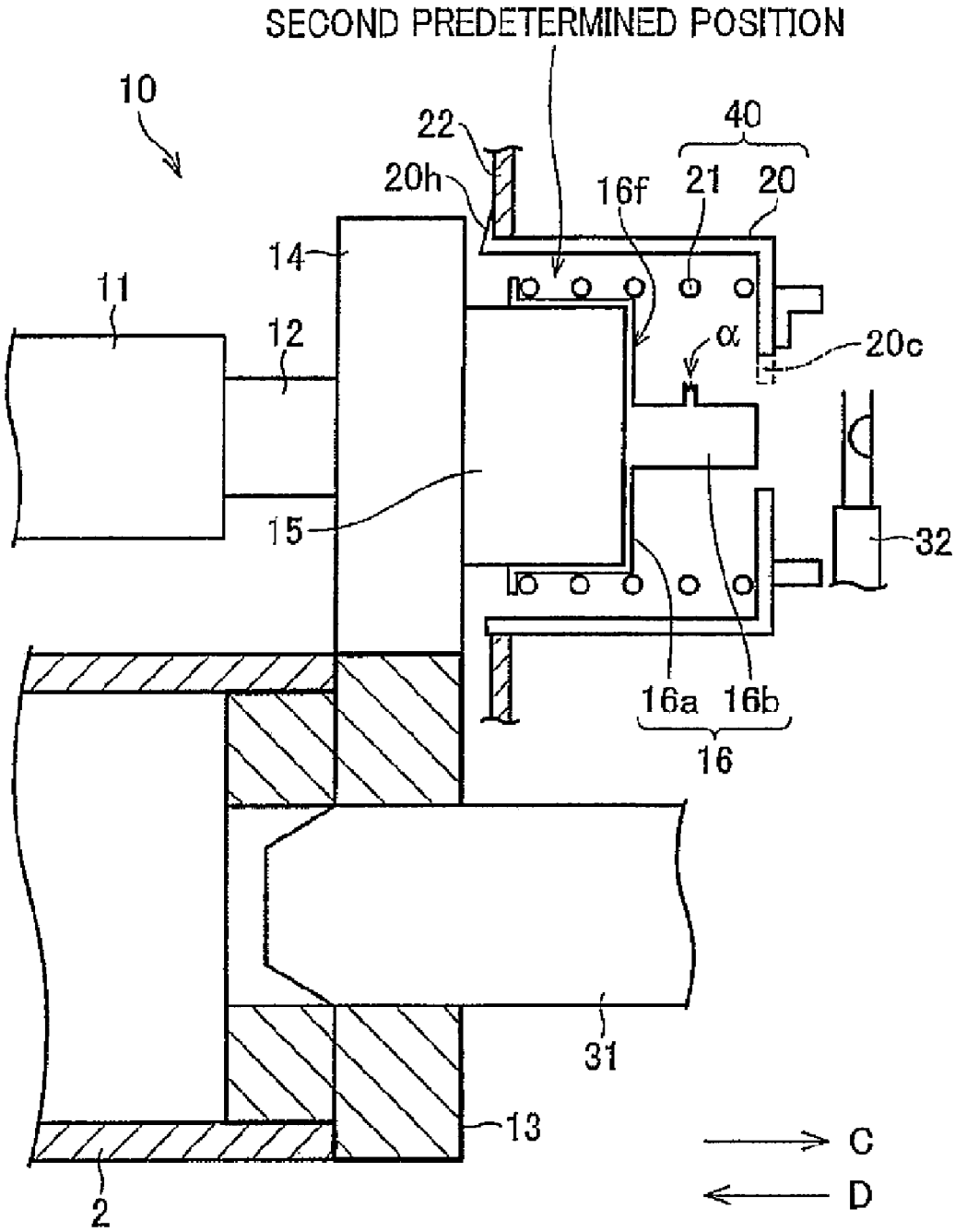
FIG. 4 is a schematic diagram illustrating a cross section of a part of the photosensitive cartridge including the state detection mechanism of the embodiment of the present invention, illustrating a state where the movable member is arranged at a second predetermined position.

As illustrated in FIG. 4, the movable member 16 moves in the D direction until all surfaces inside the movable member 16 abut to the shaft 15. Then, the axis body 16*b* is arranged at a position such that the axis body 16*b* is apart from the sensor 32. In FIG. 4, as indicated by a reference mark a, the protrusion member 16*d* has been destroyed. Hereinafter, the position of the movable member 16 as illustrated in FIG. 4 is referred to as a second predetermined position (a position apart from the first predetermined position).

As illustrated in FIG. 4, in a case where the movable member 16 is arranged at the second predetermined position, the whole back surface of the bottom surface 16*f* of the cylinder section 16*a* is pressed onto the end of the shaft 15 by the restoration force provided by the spring member 21. Accordingly, the movable member 16 arranged at the second predetermined position may move a little in the direction of the first predetermined position (the C direction) due to vibrations or the like. However, the movable member 16 is eventually pushed back to the second predetermined position by the restoration force of the spring member 21. Consequently, the movable member 16 is kept at the second predetermined position and never goes back to the first predetermined position automatically.

In the state detection mechanism 50 as explained above, when the photosensitive cartridge 10 is in the unused state, the movable member 16 is arranged at the first predetermined position and the end of the axis body 16*b* is in contact with the sensor 32 of the image formation apparatus 1 (refer to FIG. 1). In case where the sensor 32 and the end of the axis body 16*b* are in contact with each other, the image formation apparatus 1 detects that the movable member 16 is arranged at the first predetermined position and identifies that the photosensitive cartridge 10 is in the unused state.

When the photosensitive cartridge 10 is used (that is, when the unused state is cancelled), the movable member 16 moves from the first predetermined position to the second predetermined position. Thus, the movable member 16 is away form the sensor 32 (refer to FIG. 4). In case where the sensor 32 and the axis body 16*b* are not in contact with each other, the image formation apparatus 1 detects that the movable member 16 is arranged at the second predetermined position and identifies that the photosensitive cartridge 10 is in the used state (including the state in which the photosensitive cartridge 10 has been already used before but is still usable). In this way, with the state detection mechanism 50 of the present embodiment, it is possible for the image formation apparatus 1 to identify whether the photosensitive cartridge 10 is in the unused state or not.

As explained above, in the state detection mechanism 50 of the present embodiment, the supporting mechanism 40 provided in the photosensitive cartridge 10 includes the spring member (a movable-member displacement member (a member displacing a movable member), an elastic member) 21, the fringe section (a first restriction member) 20*e*, and the stopper member (a second restriction member) 20*g*.

The spring member 21 has functions of (i) supporting the movable member 16 and (ii) displacing the movable member 16 from the first predetermined position to the second predetermined position by applying pressure (restoration force) toward the second predetermined position to the movable member 16 arranged at the first predetermined position. The fringe section 20*e* has a function of restricting displacement of the movable member 16 by abutting to the protrusion member 16*d* formed on the movable member 16 arranged at the first predetermined section. The stopper member 20*g* has a function of restricting rotation of the movable member 16 in the same direction as a direction of the rotation caused by a torque transmitted from the shaft 15 (i.e. rotation in the E direction in FIG. 3), by abutting to the protrusion section 16*d* formed on the movable member 16 arranged at the first predetermined position.

When the photosensitive cartridge 10 is used in the image formation apparatus 1, the shaft (torque transmission member) 15 transmits the torque to the movable member 16 arranged at the first predetermined position. Moreover, this transmission of the torque to the movable member 16 rotates the movable member 16 until the protrusion member 16*d* abuts to the stopper member 20*g*. The torque mentioned above causes the load on the section where the stopper member 20*g* and the protrusion member 16*d* abut to each other. This load destroys the protrusion member 16*d*.

Due to this destruction, the movable member 16 arranged at the first predetermined position loses the protrusion member 16*d* which abuts to the fringe section 20*e*. This cancels the restriction to the displacement of the movable member 16 from the first predetermined position to the second predetermined position. Consequently, the movable member 16 arranged at the first predetermined position is displaced to the second predetermined position due to the restoration force (pressure towards the second predetermined position) exerted by the spring member 21. Therefore, when the photosensitive cartridge 10 is used (that is, when the unused state is cancelled), it becomes possible to displace the movable member 16, which has been arranged at the first predetermined position in the unused state, to the second predetermined position.

In the arrangement mentioned above, after the unused state is cancelled, the protrusion member 16*d* formed on the movable member 16 is destroyed (refer to the reference a as illustrated in FIG. 4). Therefore, even if someone other than a qualified supplier, for example, a user, tries to move the movable member 16 back by force manually to the first predetermined position, the restriction does not work to the displacement of the movable member 16 from the first predetermined position to the second predetermined position. As a result, the movable member 16 is arranged at the second predetermined position due to the restoration force applied by the spring member 21.

Accordingly, the arrangement mentioned above does not allow the user or the like to reassemble by hand the state detection mechanism 50 so as to return the movable member 16 from the second predetermined position to the first predetermined position. Therefore, after the unused state is cancelled, it does not happen that the movable member 16 is returned to the first predetermined position by hand of, for example, the user. As a result, it becomes possible to suppress the occurrence of an event such that the photosensitive cartridge 10 in the used state is mistakenly detected as being in the unused state.

Moreover, in the arrangement mentioned above, the spring member (elastic member) 21 is used as the movable-member displacement member for displacing the movable member 16 arranged at the first predetermined position to the second predetermined position. The spring member 21 applies the restoration force toward the second predetermined position to the movable member 16 arranged at the first predetermined member. According to this arrangement, there is an advantage in that the movable-member displacement member can be realized by an elastic member which is simple and costs low.

The movable member 16 and the cover 20 are made of resin. Note that it is preferable to arrange the movable member 16 and the cover 20 so that hardness of the protrusion member 16*d* becomes lower than that of the stopper member 20*g*. This can be realized, for example, by (i) using metal only for a material of the stopper member 20*g* of the cover 20 and (ii) using resin as a material of the movable member 16 including the protrusion member 16*d* as well as a material of the cover 20 except the stopper member 20*g*. This arrangement allows the protrusion member 16*d* to be destroyed more easily than the stopper member 20*g*. Therefore, in case where the load caused by the torque is applied to the section where the protrusion member 16*d* and the stopper member 20*g* abut to each other, the protrusion member 16*d* can be easily destroyed.

Moreover, in the arrangement mentioned above, the supporting mechanism 40 includes the cover (supporting mechanism main unit (main unit for the supporting mechanism)) 20 on which the fringe section 20*e* and the stopper member 20*g* are formed. The cover 20 is fit in the photosensitive cartridge 10. As illustrated FIGS. 1 and 2, the cover 20 has a hook section (first engaging member) 20*h*. The cover 20 is fit in the photosensitive cartridge 10 by engaging this hook section 20*h* with a frame (second engaging member) 22 of the photosensitive cartridge 10.

In this arrangement, the hook section 20*h* is destroyed when a tensile force is provided to the cover 20 in a direction (the C direction) which separates the cover 20 apart from the photosensitive cartridge 10 and load caused by this tensile force on the hook section 20*h* grows more than a predetermined amount. Namely, for example, in case where the user or the like tries to detach the cover 20 from the photosensitive cartridge 10 manually by force, the hook section 20*h* is destroyed. Then, destruction of the hook section 20*h* makes it impossible to insert the cover 20 into the photosensitive cartridge 10 again because the cover 20 is arranged so as to be inserted into the photosensitive cartridge 10 by the engagement between the hook section 20*h* of the cover 20 and the frame 22 of the photosensitive cartridge 10.

Consequently, according to the arrangement mentioned above, for example, in case where the user or the like detaches the photosensitive cartridge 10 from the state detection mechanism 50 to modify the state detection mechanism 50, the state detection mechanism 50 modified cannot be inserted into the photosensitive cartridge 10 again. As a result, it becomes possible to suppress modification of the state detection mechanism 50 by someone other than the qualified supplier, for example, the user.

It is preferable that the protrusion member 16*d* of the movable member 16 is arranged so that a width of one end close to the axis body 16*b* is smaller than that of the other end, with respect to the rotation direction (the E direction in FIG. 3) of the movable member 16. This shape makes it possible to destroy the protrusion member 16*d* more easily in case where the load caused by the torque is applied to the section where the protrusion member 16*d* and the stopper member 20*g* abut to each other.

The state detection mechanism 50 as explained above is provided in the photosensitive cartridge 10. However, the application thereof is not limited to the photosensitive cartridge 10. The state detection mechanism may be arranged in various kinds of process cartridges such as a developer tank cartridge, a charging unit, and a cleaner unit. Moreover, the application is not limited to the process cartridges of the image formation apparatus. The state detection mechanism 50 can be applied to any replaceable member that can be attached to a main apparatus detachably.

The state detection mechanism of the present invention is suitable for an arrangement in which the main apparatus detects a state of a replaceable member attached detachably to a main apparatus. The image formation apparatus is one example of this main apparatus and each of the various process cartridges attached to the image formation apparatus is one example of the replaceable member.

The state detection mechanism of the present invention includes: a supporting mechanism provided in a replaceable member attached detachably to a main apparatus; and a movable member supported by the supporting mechanism, wherein: (i) the movable member is arranged at a first predetermined position when the replaceable member is in an unused state in which the replaceable member has never been used by the main apparatus and (ii) the movable member is arranged at a second predetermined position when the unused state is cancelled, the second predetermined position being away from the first predetermined position; and the main apparatus detects the unused state by detecting the movable member arranged at the first predetermined position. The state detection mechanism further includes: torque transmission member for transmitting torque to the movable member by driving force from the main apparatus when the replaceable member is used in the main apparatus; and a protrusion member formed on the movable member, wherein: the supporting mechanism includes: a movable-member displacement member for (a) supporting the movable member and (b) displacing the movable member arranged at the first predetermined position to the second predetermined position by applying a pressure towards the second predetermined position to the movable member; a first restriction member for restricting the displacement by abutting to the protrusion member formed on the movable member arranged at the first predetermined position; and a second restriction member for restricting rotation of the movable member in a direction identical to a direction of rotation caused by the torque by abutting to the protrusion member formed on the movable member arranged at the first predetermined position; and the protrusion member is destroyed by load caused by the torque exerted on a section where the second restriction member and the protrusion member abut to each other, when the torque is transmitted to the movable member.

According to the arrangement mentioned above, when the replaceable member is in the unused state, the movable member is arranged at the first predetermined position. After the unused state is cancelled, the movable member is arranged at the second predetermined position that is away from the first predetermined position. The main apparatus identifies the unused state by detecting the movable member arranged at the first predetermined position.

When the replaceable member is used in the main apparatus, the torque transmission member transmits the torque to the movable member arranged at the first predetermined position. Moreover, this transmission of the torque to the movable member arranged at the first predetermined position produces the load caused by the torque on the section where the protrusion member of the movable member and the second restriction member abut to each other. This load destroys the protrusion member. Due to this destruction, the movable member arranged at the first predetermined position loses the protrusion member which abuts to the first restriction member. This cancels the restriction to the displacement of the movable member from the first predetermined position to the second predetermined position. Consequently, the movable member arranged at the first predetermined position is displaced to the second predetermined position due to the restoration force (pressure towards the second predetermined position) exerted by the movable-member displacement member. Therefore, when the replaceable member is used (that is, when the unused state is cancelled), it becomes possible to displace the movable member, which has been arranged at the first predetermined position in the unused state, to the second predetermined position.

In the arrangement mentioned above, after the unused state is cancelled, the protrusion member formed on the movable member is destroyed. Therefore, even if someone other than a qualified supplier, for example, a user, tries to move the movable member back by force manually to the first predetermined position, the restriction does not work to the displacement of the movable member from the first predetermined position to the second predetermined position. As a result, the movable member is arranged at the second predetermined position due to the pressure applied by the movable-member displacement member.

Accordingly, the arrangement mentioned above does not allow the user or the like to reassemble by hand the state detection mechanism so as to return the movable member from the second predetermined position to the first predetermined position. Therefore, after the unused state is cancelled, it does not happen that the movable member is returned to the first predetermined position by hand of, for example, the user. As a result, it becomes possible to suppress the occurrence of an event such that the replaceable member in the used state is mistakenly detected as being in the unused state.

In the state detection mechanism of the present invention, it is preferable that the movable-member displacement member is an elastic member which (a) elastically supports the movable member and (b) applies restoration force towards the second predetermined position as the pressure to the movable member arranged at the first predetermined position.

According to this arrangement, there is an advantage in that the movable-member displacement member can be realized by an elastic member which is simple and costs low.

In the state detection mechanism of the present invention, it is preferable that the protrusion member is made of a material whose hardness is lower than that of the second restriction member.

This arrangement allows the protrusion member to be destroyed more easily than the second restriction member. Therefore, in case where the load caused by the torque is applied to the section where the protrusion member and the second restriction member abut to each other, the protrusion member can be easily destroyed.

In the state detection mechanism of the present invention, it is preferable that the supporting mechanism further includes a supporting mechanism main unit, which is fit into the replaceable member and provided with the first restriction member and the second restriction member; the supporting mechanism main unit includes a first engaging member; the supporting mechanism main unit is fit into the replaceable member by engaging the first engaging member with a second engaging member formed on the replaceable member; and the first engaging member is destroyed by a predetermined amount of load or greater load which is exerted on the first engaging member and caused by tensile force given to the supporting member main unit in a direction parting from the replaceable member.

In this arrangement, for example, in case where the user or the like tries to detach the supporting mechanism main unit from the replaceable member manually by force, the first engaging member is destroyed. Then, destruction of the first engaging member makes it impossible to insert the supporting mechanism main unit into the replaceable member again because the supporting mechanism main unit is arranged so as to be inserted into the replaceable member by the engagement between the first engaging member and the second engaging member of the replaceable member.

Consequently, according to the arrangement mentioned above, for example, in case where the user or the like detaches the replaceable member from the state detection mechanism to modify the state detection mechanism, the state detection mechanism modified cannot be inserted into the replaceable member again. As a result, it becomes possible to suppress modification of the state detection mechanism by someone other than the qualified supplier, for example, the user.

The state detection mechanism of the present invention may be such that the main apparatus is an image formation apparatus and the replaceable member is a process cartridge of the image formation apparatus. Since many process cartridges as the replaceable members are installed into an image formation apparatus, the foregoing state detection mechanism can be used suitably for an image formation apparatus.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A state detection mechanism comprising:

a supporting mechanism provided in a replaceable member attached detachably to a main apparatus; and a movable member supported by the supporting mechanism, wherein:

(i) the movable member is arranged at a first predetermined position when the replaceable member is in an unused state in which the replaceable member has never been used by the main apparatus, and (ii) the movable member is arranged at a second predetermined position when the unused state is cancelled, the second predetermined position being away from the first predetermined position; and the main apparatus detects the unused state by detecting the movable member arranged at the first predetermined position, the state detection mechanism further comprising:

torque transmission member for transmitting torque to the movable member by driving force from the main apparatus when the replaceable member is used in the main apparatus; and a protrusion member formed on the movable member, wherein:

the supporting mechanism includes:

a movable-member displacement member for (a) supporting the movable member and (b) displacing the movable member arranged at the first predetermined position to the second predetermined position by applying a pressure towards the second predetermined position to the movable member;

a first restriction member for restricting the displacement by abutting to the protrusion member formed on the movable member arranged at the first predetermined position; and a second restriction member for restricting rotation of the movable member in a direction identical to a direction of rotation caused by the torque by abutting to the protrusion member formed on the movable member arranged at the first predetermined position; and said protrusion member is destroyed by load caused by the torque exerted on a section where the second restriction member and the protrusion member abut to each other, when the torque is transmitted to the movable member.

2. The state detection mechanism as set forth in claim 1, wherein:

the movable-member displacement member is an elastic member which (a) elastically supports the movable member and (b) applies restoration force towards the second predetermined position as the pressure to the movable member ranged at the first predetermined position.

3. The state detection mechanism as set forth in claim 1, wherein:

said protrusion member is made of a material whose hardness is lower than that of the second restriction member.

4. The state detection mechanism as set forth in claim 1, wherein:

the supporting mechanism further includes a supporting mechanism main unit which is fit into the replaceable member and provided with the first restriction member and the second restriction member;

the supporting mechanism main unit includes a first engaging member;

the supporting mechanism main unit is fit into the replaceable member by engaging the first engaging member with a second engaging member formed on the replaceable member; and the first engaging member is destroyed when tensile force, directed in a direction parting from the replaceable member, by which the supporting mechanism main unit is detached from the replaceable member, is given to the supporting mechanism main unit.

5. The state detection mechanism as set forth in claim 1, wherein:

the main apparatus is an image formation apparatus and the replaceable member is a process cartridge of the image formation apparatus.

* * * * *